United States Patent [19]

Klute et al.

[11] Patent Number: 4,763,505

[45] Date of Patent: Aug. 16, 1988

[54] ROLLING MILL STAND WITH ROLL REPLACEABILITY

[75] Inventors: Friedrich Klute, Kreuztal; Franz Schydlo, St. Ingbert; Hans D. Weitermann, Essen, all of Fed. Rep. of Germany

[73] Assignee: Fried. Krupp GmbH, Essen, Fed. Rep. of Germany

[21] Appl. No.: 20,379

[22] Filed: Mar. 2, 1987

[30] Foreign Application Priority Data

Mar. 4, 1986 [EP] European Pat. Off. ..... 86102836.3

[51] Int. Cl.[4] ..... B21B 31/10; B21B 31/16; B21B 39/14

[52] U.S. Cl. ..... 72/238; 72/242; 72/243; 72/245; 72/250

[58] Field of Search ..... 72/237, 238, 239, 241, 72/243, 245, 242, 250

[56] References Cited

U.S. PATENT DOCUMENTS 3,861,189 1/1975 Lindermann ..... 72/238
3,864,954 2/1975 Eibe et al. ..... 72/238
3,877,276 4/1975 Petros ..... 72/238
4,531,394 7/1985 Turley et al. ..... 72/238

*Primary Examiner*—Robert L. Spruill
*Assistant Examiner*—Steven B. Katz
*Attorney, Agent, or Firm*—Herbert Dubno

[57] ABSTRACT

A plurality of roll-journaling insert bodies for the upper rolls and for the lower rolls raisable and lowerable are mounted on and offset form a stand gate by feet insertable in a plurality of supporting members and, on lowering, lock successively against a motion in the direction of the roll axes and jointly are removable from the rolling-mill stand with the rolls in the axial direction. The supporting members are in the form of a plurality of supporting beams provided with a plurality of passages for the continuous unhindered passage of an item to be rolled through the rolling mill. The raising and lowering devices for the roll-journaling insert bodies can be hydraulic cylinders mounted in the supporting bars. The supporting beams are provided with continuously running grooves for the feet of the structural members.

5 Claims, 2 Drawing Sheets

ROLLING MILL STAND WITH ROLL REPLACEABILITY

FIELD OF THE INVENTION

Our present invention relates to a rolling mill with roll replaceability and, more particularly, to the roll-replacement means of a rolling mill stand.

BACKGROUND OF THE INVENTION

A known rolling mill has a roll-replacement device in which raisable and lowerable roll-journaling insert bodies for the upper rolls and roll-journaling insert bodies for the lower rolls on the stand gate are offset from and mounted in the windows of the stand gates by feet insertable in supporting members of the roll stand and, on lowering, lock with each other against a motion in the direction in which the roll axes extend and jointly are removable from the rolling mill with the rolls in this axial direction.

This type of construction is frequently used in a four high mill in tandem cold-roll lines or as an individual rolling-mill stand. The roll changing is limited to insertion of sets of rolls of the same type and size. For other sets of rolls, the entire layout of the rolling-mill stand must be changed. That is true especially for four-high mills in which both working rolls are braced by backup rolls via intermediate rolls.

OBJECTS OF THE INVENTION

It is an object of our invention to provide an improved rolling-mill stand with a roll-replacement device which overcomes the drawbacks of earlier mill stands.

It is also an object of our invention to provide an improved rolling-mill stand with a roll-replacement device which permits use of sets of rolls of different types and/or dimensions.

It is another object of our invention to provide an improved rolling-mill stand with a roll-replacement device which allows different sets of rolls to be interchanged in the shortest possible sequence or time.

SUMMARY OF THE INVENTION

These objects and others which will become more readily apparent hereinafter, are attained, in accordance with our invention, in a rolling-mill stand with a roll-replacement device in which raisable and lowerable roll-journaling insert bodies for the upper rolls and for the lower rolls are received in the windows of the stand gate and can be locked together against a relative movement in a direction generally in which the roll axes extend and wherein the rolls jointly are removable from the rolling-mill stand in this axial direction after the inserts have been form-fittingly locked together.

According to our invention, supporting members in the form of a pair of supporting bars are provided, the bars spanning the window-defining posts of the stand, extending parallel to the roll axes, receiving feet of the upper and lower insert bodies and each being formed with a respective slot-shaped passage for the continuous unhindered passage of an item e.g. a slab to be rolled through the rolling-mill stand.

Because the feet of the insert bodies can slide along channels or grooves extending substantially the full length of each bar or beam, the previously used or conventional roll-replacement unit and roll-journaling insert bodies for a four-roll stand can be used practically without modification and a set of rolls, which can be moved in or out of the rolling-mill stand past the supporting bars, can be a matter of choice as to type or dimension. The supporting bars of our invention are provided in the roll stand in place of the known supporting members usually present only in the windows and fulfill the same function.

The raising and lowering device for the roll-journaling insert bodies can be hydraulic cylinders mounted in the supporting bars simultaneously also causing roll bending or provided in addition to those provided for roll bending.

Hose connections or couplings need not be loosened for the roll changing, since the hydraulic connectors are permanently provided on the supporting bars.

The supporting bars can be provided with guide grooves which extend over the entire length of each bar to receive the feet of the structural members. Because of that, it is possible to effect the roll changing, including replacement of components between the roll-journaling insert bodies, most simply and quickly on replacement of a set of rolls.

According to a further feature of our invention, the supporting bar downstream of the rolls (with respect to the rolling direction) can be equipped with a plurality of adjusting cylinders above and below one of the passages of that supporting bar. These adjusting cylinders act opposite to the rolling direction of the rolling-mill stand on wedge-shaped blocks for positioning of a plurality of lateral rolls (laterally bracing the working rolls) in multiroll stands. This arrangement allows problem-free insertion of different sets of rolls and simultaneously guarantees a precise, tensional and reliable adjustment of their wedge block by direct application of force therefore.

To minimize the structural height of the supporting bars or beams, it is particularly advantageous to provide the lower adjusting cylinders of the front one of the wedge blocks at the same height as the guide groove in the supporting bar downstream of the rolls. For spanning the space between the respective adjusting cylinders and the wedge block, a slidable elongated shim of suitable thickness, can be fitted in the guide groove downstream of the rolls between the roll-journaling insert bodies slidable with them. Another corresponding shim can be fitted in an upper guide groove in the supporting bar downstream of the rolls. Of course, such shims can also be provided between the insert bodies and adjusting cylinders in respective grooves of the upstream beam as well.

The shims are not necessary for sliding of the roll-journaling insert bodies in roll changing, and hence slidability of the shims in the direction of the roll axes need not be provided. The arrangement allows the use of shorter adjusting cylinders and results in a good distribution of the adjusting forces on the wedge blocks.

BRIEF DESCRIPTION OF THE DRAWING

The above and other objects, features and advantages of our present invention will become more readily apparent from the following description, reference being made to the accompanying highly diagrammatic drawing in which.

SPECIFIC DESCRIPTION

Figure 1:
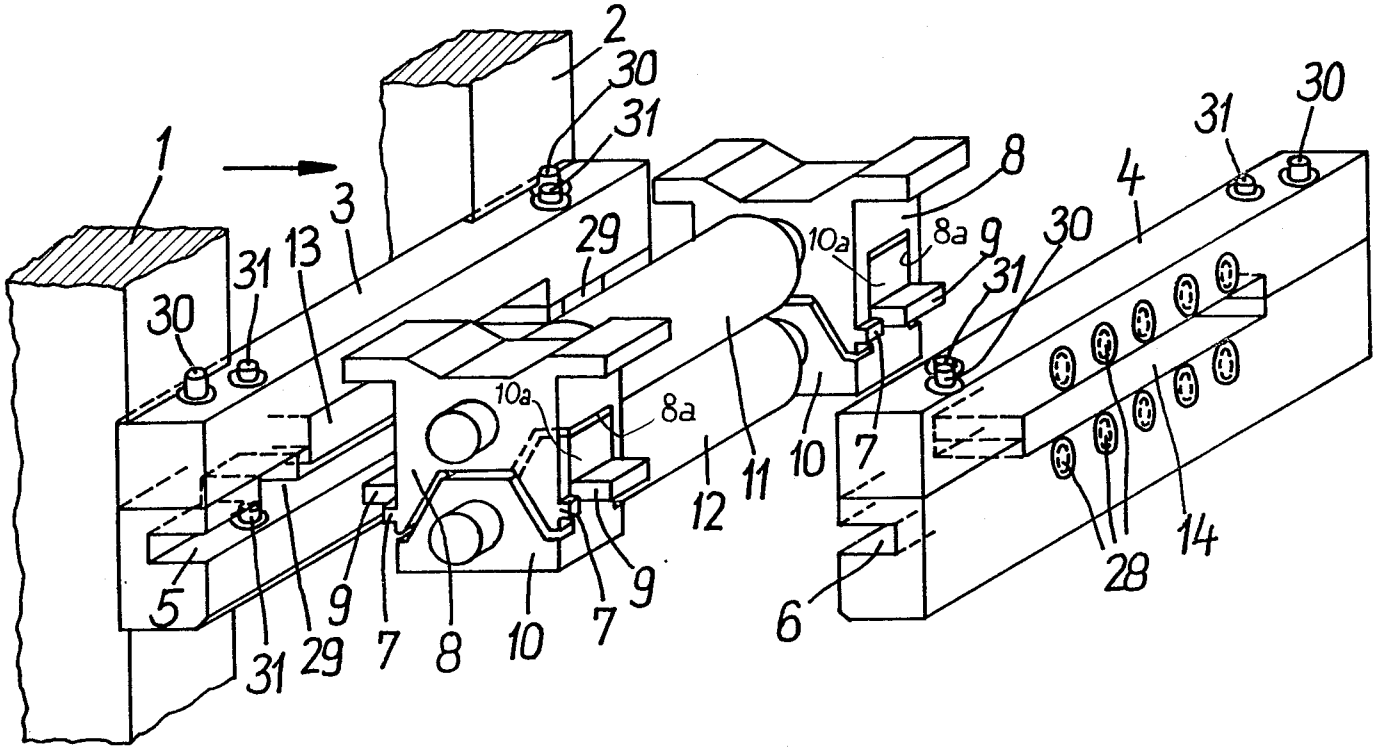
FIG. 1 is a schematic perspective view of a portion of a four-high rolling-mill stand with the roll-replacement device according to our invention and with the backup rolls and their journal blocks (which can engage in similar beams to those described herein) removed.

The stand end piece 1 at the rear of the roll stand shown in FIG. 1 on the right side of the rolling-mill stand when facing in the rolling direction indicated by the arrow and the corresponding stand end piece 2 on the left side of the rolling-mill stand are attached to each other on the inside of the stand gate window by a rear supporting bar or beam 3.

A front supporting bar or beam 4 attaches the stand end pieces (not shown) on the opposite side of the windows of the stand gate or frame.

The supporting bars 3 and 4 are provided with guide grooves 5 and 6 each for receiving a foot 7 of the upper structural member 8 and a foot 9 of the lower structural member 10.

In the upper and lower roll-journaling insert bodies 8 and 10 according to FIG. 1 an upper working roll 11 and a lower working roll 12 are mounted in the roll stand which can be a four-high mill whose backup rolls have not been illustrated. The supporting bars 3 and 4 are provided with slot-like passages 13 and 14 for feeding through of the article, e.g. a slab, to be rolled by the roll stand.

Figure 2:
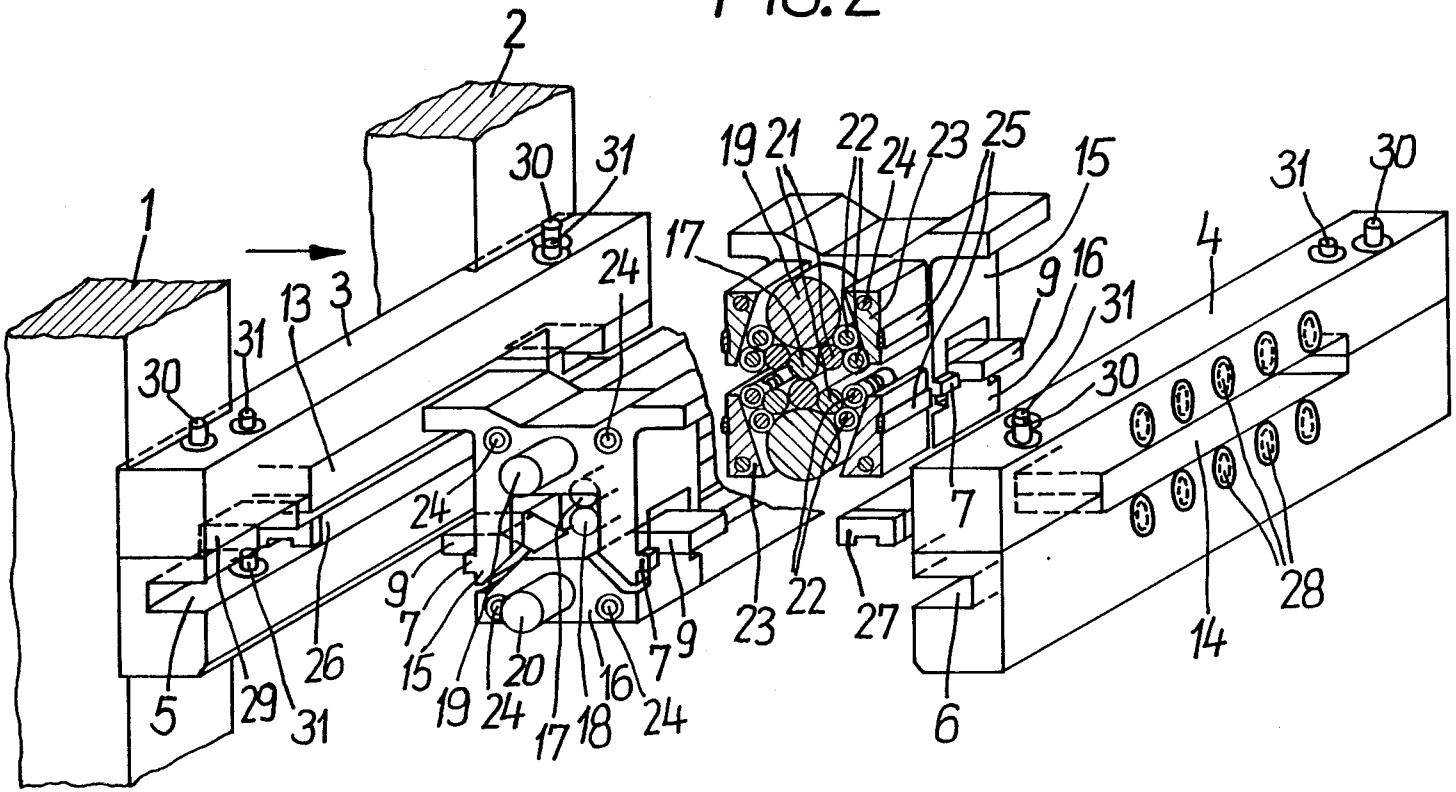
FIG. 2 is a partially cross sectional, partially cutaway perspective view of a multiroll rolling-mill stand (e.g. a six-high stand) with the roll-replacement device of FIG. 1 with only the intermediate and working rolls (and lateral bracing rolls) illustrated, the backup rolls having been omitted.

According to FIG. 2, the mounting of the rolls of the multiroll mill (e.g. a six-high mill whose backup rolls have been omitted from the drawing), of course, the upper and lower working rolls 17 and 18 and the upper and lower backup rolls 19 and 20, is provided by roll-journaling insert bodies 15 and 16 of a suitable outer shape. The lateral intermediate rolls 21 engaging the working rolls 17,18 and a pair of lateral intermediate rolls 22 for each lateral intermediate roll 21 are mounted as seen in FIG. 2 and can be braced by the wedge blocks 23 which are pivotable on pivot axes 24.

They are positioned by shim strips 25 in shims 26 and 27 and/or on the supporting beam 3. Their adjustment is effected by rows of horizontal adjusting cylinders 28 (and respective pistons) in supporting beam 4 above and below the passage 14.

The shims 26 and 27 are slidable in the guide grooves 5 and 6 and can be withdrawn with the roll-jcurnaling insert bodies 15 and 16 of the four high mill.

Upstream of the upper adjusting cylinders 28 of bar 4, however, there is a corresponding fitting piece which can remain on the supporting beam 4 and need not be slidable. To facilitate the raising of the lower roll-journaling insert bodies 10 and 16 in the working position, cutouts 29 (for the feet 9) are provided in the supporting beams 3 and 4. Moreover, the bending cylinders 31 for bending the rolls engaging the upper roll-journaling insert bodies 8 and 15 and the lifting cylinders 30 for balancing the unshown intermediate rolls are positioned in the supporting beams 3 and 4 in the upper end wings thereof.

As can be seen from FIG. 1, the insert bodies 8 have recesses 8*a* in which projections 10*a* of bodies 10 are engageable to lock the insert bodies against relative motion in the axial direction.

We claim:

1. A rolling-mill stand, comprising:

a pair of stand uprights at opposite sides of the stand and formed with respective windows;

respective lower-roll journaling insert bodies received in said windows;

respective upper-roll journaling insert bodies received in said window above each lower-roll journaling insert body, each upper-roll journaling insert and the respective lower-roll journaling body being so formed as to lock together against relative motion along a roll axis, said insert bodies in each window being relatively raisable and lowerable therein;

a lower roll journaled in said lower-roll journaling insert bodies and an upper roll journaled in said upper-roll journaling insert bodies for rolling a workpiece between said rolls, said rolls and said bodies being jointly removable from said stand in an axial direction by locking of said upper and lower bodies together; and supporting beams bridging said uprights across a path of said workpiece through said stand and received in said windows on opposite sides of said bodies in each window, each of said supporting beams having guides extending substantially the lengths of said beams, said insert bodies having feet receivable by said guides for displacement of said rolls and said bodies jointly relative to said beams upon removal from said stand in said axial direction, said supporting beams being formed with mutually aligned openings permitting passage of said workpiece therethrough as said workpiece passes between said rolls.

2. The rolling mill stand defined in claim 1 wherein said supporting beams are provided with hydraulic cylinders acting upon said upper-roll and lower-roll journaling insert bodies for raising and lowering said rolls.

3. The rolling mill stand defined in claim 1 wherein said guides are guide grooves formed in said beams and receiving said feet of said members.

4. The rolling mill stand defined in claim 3 wherein one of said beams downstream of said rolls in a direction of movement of said workpiece through said stand is equipped with a plurality of adjusting cylinders above and below the respective said opening and acting upon at least one wedge in a direction perpendicular to said axial direction for positioning a plurality of lateral intermediate rolls between said upper and lower rolls and a respective wedge.

5. The rolling mill stand defined in claim 4 wherein said upper roll and said lower roll are braced by respective pluralities of lateral intermediate rolls and respective wedges, at least a lower one of said wedges having a slidable fitting piece received in a guide groove of the respective supporting beam, upper and lower wedges also being provided upstream of said upper and lower rolls for pressing additional pluralities of lateral intermediate rolls against said upper and lower rolls, said lower wedge upstream of said upper and lower rolls being provided with another fitting piece receivable in the guide groove of the supporting beam upstream of said upper and lower rolls.

* * * * *